US010888477B2

(12) United States Patent
Bernal

(10) Patent No.: US 10,888,477 B2
(45) **Date of Patent: *Jan. 12, 2021**

(54) BED WITH MECHANISM FOR ASSISTING AN OCCUPANT TO STAND UP HAVING A SENSOR WITH ENERGY GENERATION

(71) Applicant: Wissner-Bosserhoff GmbH, Wickede (DE)

(72) Inventor: Carlos Bernal, Soest (DE)

(73) Assignee: Wissner-Bosserhoff GmbH, Wickede (DE)

( * ) Notice: Subject to any disclaimer, the term of this patent is extended or adjusted under 35 U.S.C. 154(b) by 308 days.

This patent is subject to a terminal disclaimer.

(21) Appl. No.: 15/965,265

(22) Filed: Apr. 27, 2018

(65) Prior Publication Data

US 2018/0311094 A1 Nov. 1, 2018

(30) Foreign Application Priority Data

Apr. 28, 2017 (EP) ..... 17168745

(51) Int. Cl.
*A61G 7/053* (2006.01)
*A61G 7/012* (2006.01)
(Continued)

(52) U.S. Cl.
CPC ..... *A61G 7/053* (2013.01); *A61G 7/005* (2013.01); *A61G 7/012* (2013.01); *A61G 7/018* (2013.01);
(Continued)

(58) Field of Classification Search
CPC ..... A61G 7/053; A61G 7/005; A61G 7/012; A61G 7/018; A61G 2203/10; A61G 2200/16; A61G 2203/12; A61G 2203/70
See application file for complete search history.

(56) References Cited

U.S. PATENT DOCUMENTS 9,463,126 B2 * 10/2016 Zerhusen ..... A61G 7/012
9,827,156 B2 * 11/2017 Zerhusen ..... A61G 12/00
(Continued)

FOREIGN PATENT DOCUMENTS

DE 102014008388 A1 12/2015
WO 2007075701 A2 7/2007

OTHER PUBLICATIONS

Phea by Honeywell, "Easyclickpro Funksystem-Die Neue Generation (Firmenschrift)," pp. 1-60 (Mar. 2014), www.enocean-alliance.org/wp-content/uploads/2016/11/Easyclickpro 05.pdf.
(Continued)

*Primary Examiner* — Eric J Kurilla
(74) *Attorney, Agent, or Firm* — Edell, Shapiro & Finnan, LLC.

(57) ABSTRACT

A bed comprises: a height-adjustable lying surface; a head part, a foot part, and/or at least one side part; a motor for adjusting the height of the lying surface; and a control system for controlling the motor to adjust the height. The control system comprises at least one sensor and at least one actuator. The sensor includes: at least one actuating element that can be actuated to generate a control signal; an interface to emit the control signal; and at least one element for producing energy, by which energy needed for generating and transmitting the control signal can be generated via actuation of the sensor from the outside. The actuator includes: an interface to receive the control signal; and a switching element to switch at least one current path or an adjusting element to set at least one voltage, one current, or another physical variable based on the control signal.

16 Claims, 6 Drawing Sheets

(51) Int. Cl.

| | |
|---|---|
| ***A61G 7/018*** | (2006.01) |
| ***H01H 3/14*** | (2006.01) |
| ***H01H 25/00*** | (2006.01) |
| ***A61G 7/005*** | (2006.01) |

(52) U.S. Cl.
CPC ..... *H01H 3/14* (2013.01); *H01H 25/00* (2013.01); *A61G 2203/10* (2013.01)

(56) References Cited

U.S. PATENT DOCUMENTS

| | | | | |
|---|---|---|---|---|
| 10,206,836 | B2 * | 2/2019 | Zerhusen | A61G 12/00 |
| 2002/0066142 | A1 * | 6/2002 | Osborne | A61G 7/0509 5/600 |
| 2011/0119940 | A1 * | 5/2011 | Zerhusen | G01C 9/10 33/333 |
| 2011/0169653 | A1 * | 7/2011 | Wang | A61G 7/012 340/686.6 |
| 2011/0234411 | A1 * | 9/2011 | Harrington | G06F 19/328 340/573.4 |

OTHER PUBLICATIONS

European Search Report in corresponding EP Application No. 17168745, dated Oct. 18, 2017.

* cited by examiner

BED WITH MECHANISM FOR ASSISTING AN OCCUPANT TO STAND UP HAVING A SENSOR WITH ENERGY GENERATION

CROSS REFERENCE TO RELATED APPLICATIONS

This application claims foreign priority under 35 U.S.C. § 119(a)-(d) to Application No. EP 17168745.2 filed on Apr. 28, 2017, the entire contents of which are hereby incorporated by reference.

TECHNICAL FIELD

The present invention relates to a bed, in particular a hospital bed or nursing care bed, having a mechanism for assisting standing up.

BACKGROUND

Under the designation "eleganza 1," the applicant offers a bed that is equipped with a mechanism for assisting a bed occupant to stand up. The mechanism comprises a handle, which is referred to as a "Mobi-stick." The handle is mounted in a holder on one side of the bed. The handle allows an occupant sitting on the edge of the bed to pull up on the handle and/or support themselves on the handle when leaving the bed, i.e., when standing up. Furthermore, provided on the handle are switches, which occupants can actuate with a thumb to adjust the height of the lying surface while holding on to the handle, or pulling themselves up or supporting themselves on the handle. The adjustment of the lying surface assists the occupant and provides support for the occupant in the process of standing up. This mechanism for assisting standing up is also used in the applicant's other beds, wherein it is then sometimes referred to as "Mobi-lift."

In practice, the described handle provides a great service to the occupant. It contributes to the mobilization of the occupant and helps to unburden the nursing staff.

One disadvantage of the handle is that it has a fixed position on a side of the bed. If an occupant is to be able to leave the bed on either side with the assistance of the handle, a handle has to be provided on each side. This is expensive. Even the connection of the switches integrated into the handle with a controller for drives for the adjustment of the lying surface requires an installation effort that cannot be overlooked, in particular because of the arrangement of the wiring. This can be eliminated with radio interfaces in the sensor and in the actuator and with batteries for the supply of energy to the sensor. The battery state of charge has to then be checked regularly, however, which requires additional effort in practice.

SUMMARY

The present invention builds on the aforementioned.

The underlying task of the present invention is to propose a bed with a mechanism for assisting a bed occupant to stand up, which is designed in a less complex manner.

The task is solved according to the invention in that a sensor comprises at least one element for producing energy, by which the energy needed for generating and transmitting the control signal can be generated via the actuation of the sensor from the outside.

The sensor is thus independent of a wired energy supply or an energy supply provided by a battery. Consequently, the wiring layout between the sensor and an energy source does not have to be taken into consideration. It is of similarly little concern whether batteries can ensure a sufficient energy supply. It is not necessary to pay attention to the state of charge of batteries.

The interface of the sensor and the interface of the actuator of the control system of a bed according to the invention can be radio interfaces. A wired connection between the interfaces is therefore unnecessary as well, and the guidance of a wire between the interfaces does not have to be taken into consideration when placing the sensors. If a plurality of actuators are provided in a bed according to the invention, each actuator preferably has an interface or radio interface.

The sensor and the actuator or actuators can correspond to the EnOcean standard or to a similar standard. Sensors and actuators communicate via radio interfaces, and the sensors according to the EnOcean standard comprise an element for producing energy. Sensors and actuators according to the EnOcean standard are increasingly being used in domestic installations to control lights, blinds and other domestic technology components. Sensors and actuators according to the EnOcean standard are not used in beds, in particular nursing care beds or hospital beds.

The sensor of the control system of a bed according to the invention can comprise at least one fastening element, by which the sensor can be attached to the head part, the foot part, and/or the side part, and the head part, the foot part and/or the side part of the bed can comprise a support structure or support structures, on which the sensor can be releasably mounted by interaction with the at least one fastening element.

The fact that the sensors comprise one or more fastening elements, by which the sensor can be releasably attached to the bed, allows a good positionability of the sensor of the control system of a bed according to the invention to be achieved.

The sensor can preferably be mounted to the support structure or the support structures and removed again without a tool.

A bed with a control system, which offers wireless signal transmission from the at least one actuating element to a switching element or adjusting element, in which an element for producing the energy required for generating the signals to be transmitted is at the same time also provided in the sensor, thus making a wired energy supply for the sensor unnecessary, enables free positionability of the sensor with its fastening elements on the support structures on the at least one side part, foot part, and/or head part.

The element for producing the energy required for generating the signals to be transmitted can be a piezo element, a solar cell, a Peltier element or an electrodynamic energy converter.

The actuating element can be suitable and configured for mechanical actuation and can be operatively connected to the piezo element or to the electrodynamic energy converter. The actuating element can be a rocker or a key, for example, or can be actuated via a rocker or a key.

According to the invention, a provision can be made that an activation signal, with which the receiver side parts are activated for the reception of control signals, is transmitted to the receiver side part of the control system by the simultaneous actuation of all or some of the actuating elements of the sensor.

A bed according to the invention can comprise at least one further motor, for example for adjusting the inclination of the lying surface or a part of the lying surface.

For the sensor of the control system of a bed according to the invention, the fastening element can form a receptacle, e.g., with undercut edges. The receptacle can be plugged, clipped or pushed onto the support structure of the side part, the head part or the foot part, and the support structure can be designed to be complementary to the receptacle.

It is particularly advantageous if a bed according to the invention comprises a handle as a mechanism for assisting standing up, and the handle and the sensor form a common component of the bed. The bed occupant can then grip the handle of the bed, to hold on to it or for support. At the same time, the bed occupant can actuate the actuating element or elements, for example, to actuate the motor to raise or lower the lying surface. Raising or lowering the lying surface can make it easier for the occupant to get up out of the bed or to get into the bed.

The handle can comprise a foot, which comprises the fastening element or elements, and a head. The head and the foot of the handle or sensor can preferably be rotatably connected to one another. The at least one actuating element can advantageously be provided in or on the head. The head with the at least one fastening element arranged on or in it can then be rotated such that, when gripping the handle, the occupant can easily reach and actuate the fastening element or the fastening elements. The at least one actuating element should preferably be reachable with the thumb of the hand with which the occupant is gripping the handle.

The handle may be ergonomically shaped. The head, in particular, can substantially have a spherical shape or a barrel shape.

Particularly for patient care and elder care, such a bed can make a valuable contribution toward a person being cared for regaining autonomy.

A significant advantage of the bed according to the invention is that the sensors can be used without the constraints of a wired (or battery-supported) energy supply and without the constraints of a wired signal transmission. They can be freely positioned in a wide variety of ways, so that they can be reached comfortably, and, if need be, without compromising the safety of the person being cared for, by the person being cared for or a caregiver.

Another important advantage of the bed according to the invention is that the sensors can easily be separated from one another and from other parts of the control system. The sensors can therefore easily be taken into a room other than the one in which the actuators associated with the sensors are located.

It is possible for a sensor to be used to actuate multiple drives of a bed, so that the various components of the bed are configured in a way that makes it easy to get up out of and into the bed.

It is possible to remove the sensor of a bed according to the invention from the bed and mount it to a wheelchair or a walking aid. A bed can thus conveniently be actuated from the wheelchair or from the walking aid by the sensor mounted thereon, such that the components of the bed assume the necessary positions for the patient to get in easily ahead of time. After getting in, or even while getting into the bed, the sensor can then be remounted to the bed.

Another important advantage of the control system according to the invention is that a sensor of a nursing care bed can also respond to actuators outside the bed, for example actuators by which, e.g., the ceiling light can be turned on and off, for example, or blinds or windows can be opened or closed.

The actuating elements of a sensor can comprise temperature sensors, motion detectors, brightness sensors, force, pressure or weight sensors or the like. Suitable actuators are, in particular, relays, digital and analog outputs, dimmers, etc.

A sensor can comprise not only one, but also a plurality of actuating elements, by which the same or different control signals can be generated. A sensor can be designed such that the actuating element or the actuating elements generate the same or different control signals at the same time in response to one actuation, or the same or different control signals in response to different actuations. Different actuations of a sensor could be achieved in that the sensor comprises a plurality of rockers or keys, or the rocker or the key can be moved in different ways, for example in two different directions or at different speeds.

According to the invention, the sensor can comprise a protective element by which the actuating element can be protected against unintentional actuation. The protective element can be a cover, for example, that is pivotably or slidably attached to a housing of the sensor.

It is particularly advantageous that a plurality of actuators of the control system can be programmed such that they receive the same control signal emitted by the sensor or one of the sensors. This control signal triggers the switching element of the actuator or the switching elements of the actuators for switching the at least one current path, or the adjusting element of the actuator or the adjusting elements of the actuators for adjusting the at least one voltage, the at least one current or the other physical variable based on the received control signal. By a sensor and a control signal emitted by the sensor, it is thus possible to respond to a plurality of actuators at the same time. These actuators are programmed such that they receive the control signal and control the switching element or the adjusting element on the basis of the received control signal. There is no need for a (central) control device to simultaneously activate or deactivate or adjust various components or devices. A (central) control device, which receives the control signal and controls a plurality of switching elements or adjusting elements, can nonetheless be provided.

All or some of the actuators can be disposed in a common housing. The switching elements and/or the adjusting elements can also be mounted outside the housing on the components to be switched and/or adjusted. The switching elements and/or the adjusting elements can also be mounted within the housing and connected to the components to be switched and/or adjusted via wired connections.

BRIEF DESCRIPTION OF THE DRAWINGS

Other characteristics and benefits of the present invention become apparent based on the following description of preferred embodiments by reference to the included figures. The figures show.

DETAILED DESCRIPTION

Figure 2:
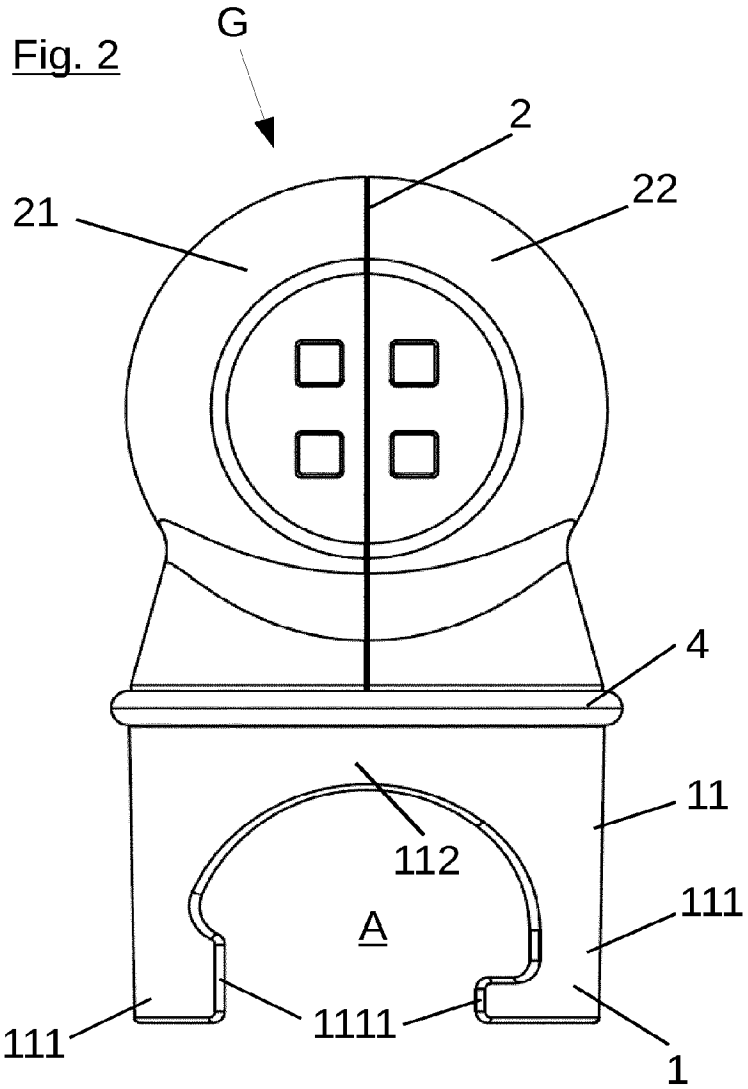
FIG. 2 is a view of the handle-sensor unit from the rear.

The handle-sensor unit, also referred to in the following text as a unit, of a bed according to the invention comprises a head 2 and a foot 1. The head 2 is rotatably mounted on the foot 1.

The foot 1 has a fastening element 11, which forms a receptacle A. A support structure of the bed can be placed into the receptacle A for the purpose of mounting the unit to a bed according to the invention. The fastening element 11 comprises two projecting limbs 111, which are disposed at a distance from one another on a first end of the foot 1. The two limbs 111 and a support 112 connecting them delimit the approximately C-shaped receptacle. The limbs 111 comprise ends 1111 facing towards one another, which results in undercuts.

The support structure of a bed according to the invention or of another object, for example a patient vehicle, in particular a wheelchair, or a walking aid, in particular a crutch or a rollator, placed into the receptacle A is enclosed by the limbs. Since the receptacle is laterally open, elongated support structures can also be placed into the receptacle, in particular a handrail or an end bar on a head part, a foot part or a preferably lowerable or extendable side part. If the handrail or the end bar has a cross section that is uniform at least in sections and the clear cross section of the fastening element 11, i.e., the receptacle, is uniformly shaped at least in sections, the foot 1 can be shifted on the support structure to fix its position. The clear cross section of the receptacle A is preferably adapted to the outer cross section of the support structure.

In addition to the fastening element 11, the foot 1 comprises a slewing ring 12. This slewing ring 12 is formed by an edge that is circular in cross-section. A crown gear toothing 13 is provided within, and coaxial to, the slewing ring 12. A pin 14 is disposed within, and coaxial to, the crown gear toothing 13. The pin 14 has a central hole through which a screw 3 is guided, the screw head 31 of which rests against a ledge 141 of the bore. Away from the ledge 141, the hole has a hexagonal cross-section, so that an external hexagon of the screw head can be accommodated in the hole in a rotationally fixed manner.

Inside the ledge through which the shaft of the screw 3 is guided, the hole preferably has a circular cross section. The screw 3 projects out of the pin 14.

The head 2 of the unit comprises a housing with two symmetrical housing shells 21, 22. The housing shells 21, 22 are connected by adhesive bonding, but can also be connected to one another in any other suitable manner, for which constructive modifications to the housing shells 21, 22 may be necessary. The housing shells 21, 22 form a base which serves to connect the head 2 to the foot. The base comprises a ring 25 with a peripheral ledge, which engages in the slewing ring 12 or sits on the slewing ring 12 with the interposition of an O-ring 4. A crown toothing 26 is provided on the ring, which is coaxial to the ring 25 and engages in the crown toothing 13 of the foot. The crown toothings 13, 26 are toothed in the same manner.

The pin 14 engages in the ring 25 and forms a pivot bearing for the pin 14.

The assembled housing shells 21, 22 form a barrel-shaped handle piece, which can be clasped by a hand in order to hold onto, find support or pull up on the unit.

The housing further comprises a housing insert 23. The housing insert is inserted into an opening cleared by the assembled housing shells 21, 22. The housing insert 23 is formed in the manner of a trough and accommodates a sensor 5 of the unit. The housing insert 23 and the sensor 5 disposed therein are covered to the outside by operating elements 6, namely two rocker switches 61, 62 and a pushbutton 63.

The rocker switches 61, 62 are pivotably mounted on pins and/or axes of the sensor, and are supported on restoring and energy generating elements 51 of the sensor 5 via first pins 621. The rocker switches 61, 62 can be deflected out of a rest position defined by the restoring and energy-generating elements 51 by an actuation. The restoring and energy generating elements 51 of the sensor are thereby likewise deflected. The energy required for generating and transmitting a control signal is thereby generated in the sensor 5. If there is then no actuation, the restoring and energy generating elements 51 push the rocker switches 61, 62 into their rest position. Second pins 622 of the actuating rockers 61, 62 rest against actuating elements 52 of the sensor. A deflection of the rocker switches 61, 62 causes the second pins 622 to move the actuating elements 52, which leads to the generation and transmission of the control signal that can be received by an actuator of the control system of the bed to then switch a switching element, if a receiver side part of a control system of a bed according to the invention is activated. No switching elements are switched if the receiver side part of the control system, which among other things comprises the actuators, is not activated.

The sensor 5 has four actuating elements 52, whereby each of the two rocker switches 61, 62 can actuate two of the actuating elements 52.

The pushbutton 63 comprises a knob 631, which projects outward in a recess between the rocker switches 61, 62. The pushbutton 63 comprises first pins 633, which are supported on the restoring and energy generating elements 51 of the sensor. The pushbutton 63 further comprises four second pins 632, each of which rests against one actuating element 52 of the sensor. The pushbutton 63 is mounted in a linearly displaceable manner. If the pushbutton 63 is pressed, all four second pins push onto the actuating elements 52 of the sensor 5, which results in the generation and transmission of an activation signal. The reception of this activation signal causes the receiver side part of the control system, which also includes the actuators of the control system, to be activated.

The simultaneous pushing of all four actuating elements 52 upon actuation of the pushbutton 63 therefore results in an activation of the receiver side part of the control system. The receiver side part of the control system is capable of processing the control signal transmitted by the sensor 5 on the basis of the actuation of a single actuating element 52 by the rocker switches 61, 62, and switching elements in accordance with the control signal, only in an activated state of the receiver side part of the control system. If the receiver side part of the control system is not activated, there is no discernible reaction to the control signals triggered by the actuation of a single actuating element 52 at the switching elements.

If the receiver side part of the control system is activated, control signals for controlling the switching elements can be received within a defined period of time. If there is no actuation within this defined period of time, the receiver side part of the control system falls back into the non-activated state.

The activation of the receiver side part of the control system by the simultaneous actuation of all or many of the actuating elements of the sensor is also possible with a differently designed sensor of a bed according to the invention, and is not possible only with the handle-sensor unit shown in the figures.

The head 2 is secured to the foot 1 by a nut 7. For this purpose, the nut 7 is screwed onto the screw 3, which projects into the head 2. A spring 8 is inserted between the nut 7 and the ring 25 of the head 2 and is supported on the nut 7 on the one side and on the ring 25 on the other side. The head 2 can be pulled away from the foot 1 in the direction of the screw 3 against the pressure of the spring 8. The crown toothings 13, 26 of the foot 1 and the head 2 are thus released from one another and the head 2 can be freely rotated relative to the foot 1. If the head 2 is released in the desired position, the spring 8 pulls the head 2 toward the foot 1. The crown toothings 13, 26 come into engagement and the head 2 is fixed to the foot 1.

Figure 9:
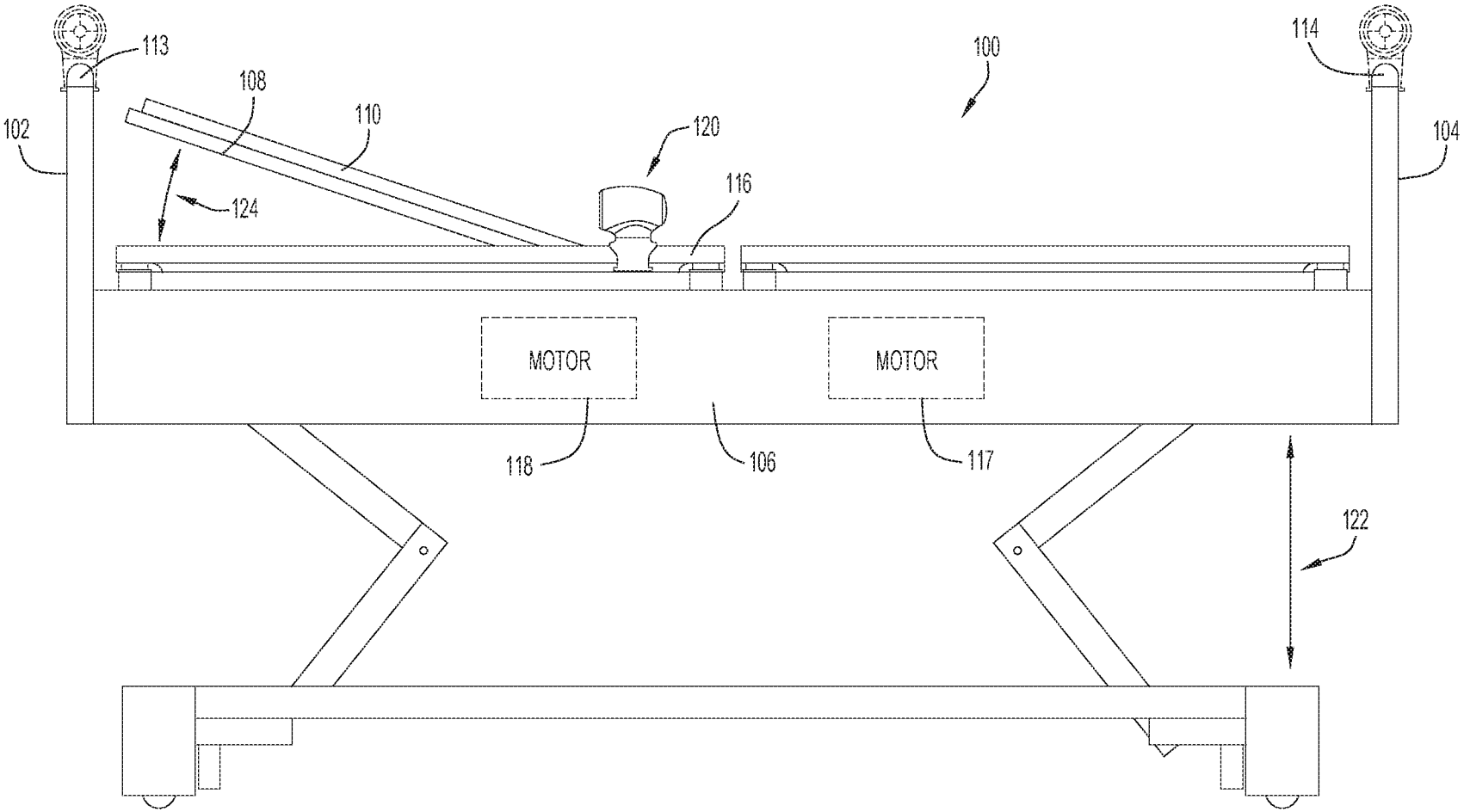
FIG. 9 is a side view of a bed diagrammatically illustrating the handle-sensor unit of FIGS. 1-2 mounted to support structure of the bed according to an example embodiment of the present invention.

Referring now to FIG. 9, an example embodiment of a bed 100, particularly (but not limited thereto) a hospital bed or nursing bed having a handle-sensor unit mounted to support structure of the bed for assisting a bed occupant to stand up, is depicted and will now be described.

Figure 1:
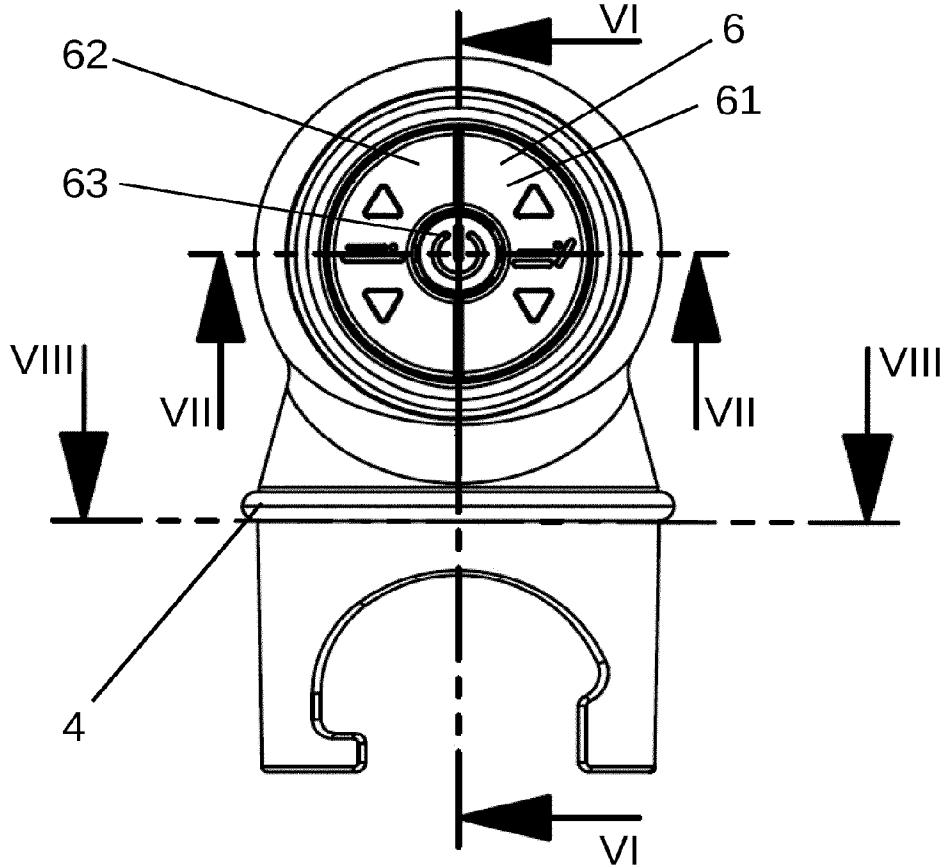
FIG. 1 is a view of a handle-sensor unit from the front.
Figure 4:
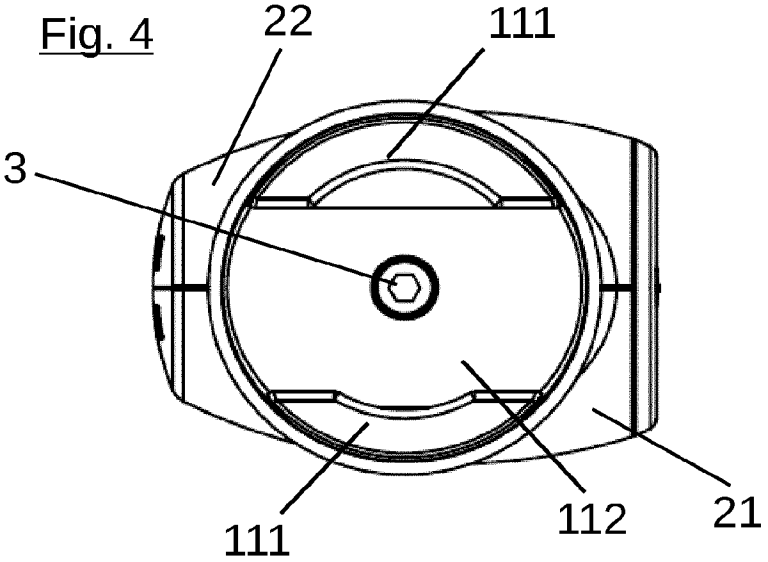
FIG. 4 is a view of the handle-sensor unit from below.
Figure 5:
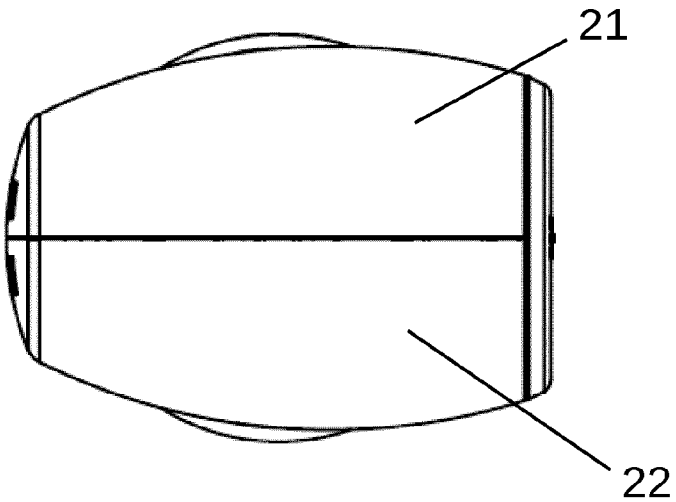
FIG. 5 is a view of the handle-sensor unit from above.
Figure 3:
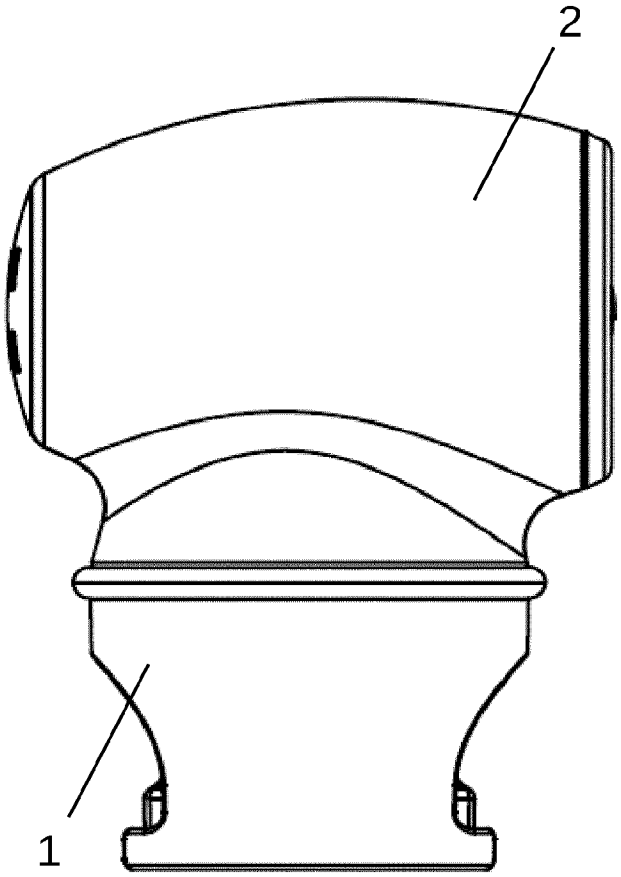
FIG. 3 is a view of the handle-sensor unit from the side.
Figure 6:
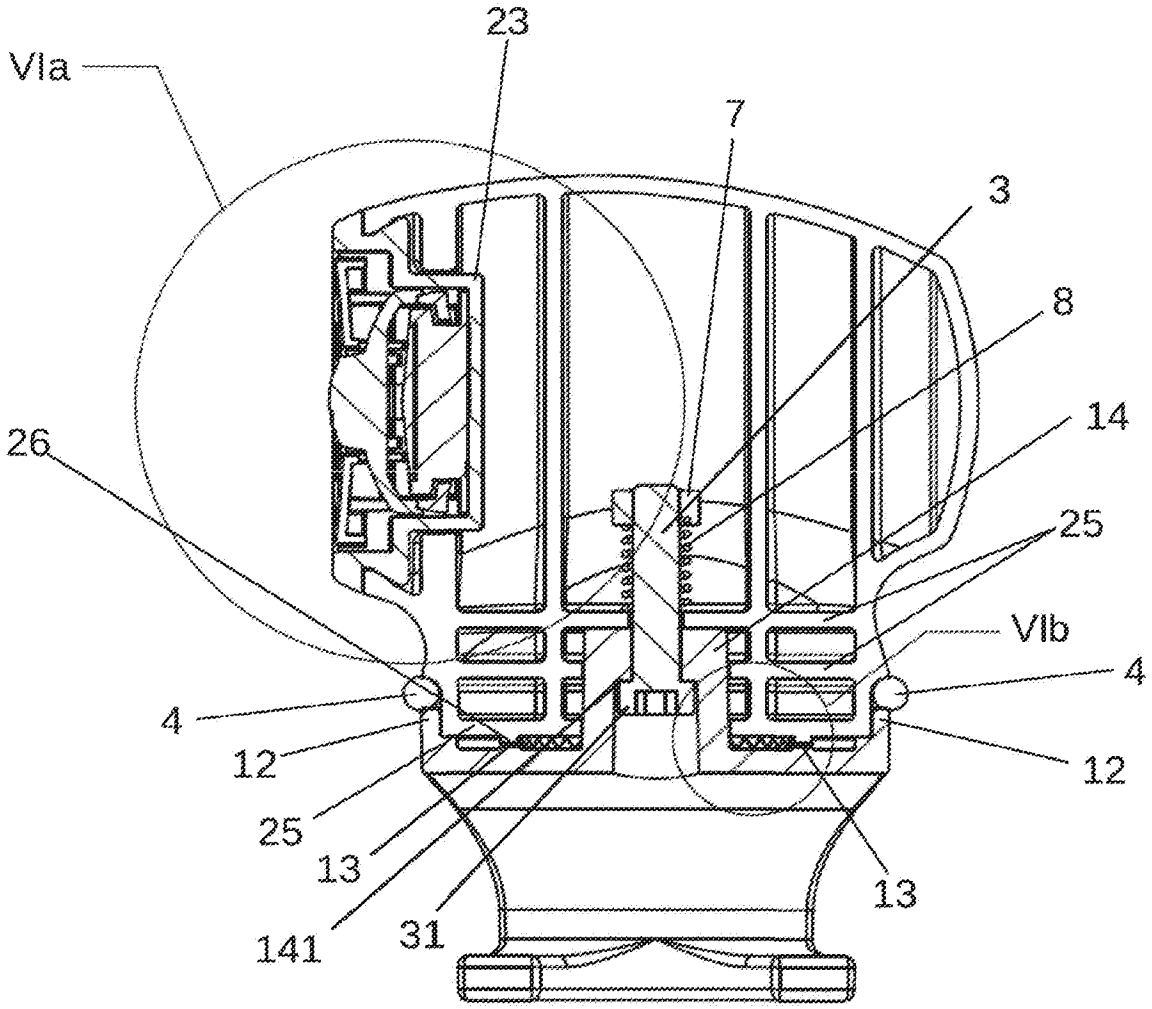
FIG. 6 is a section through the handle-sensor unit along the line VI-VI in FIG. 1.
Figure 6B:
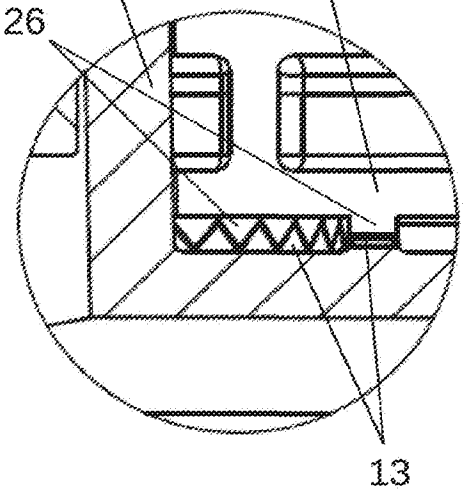
FIG. 6*b* is a detail VIb from FIG. 6.
Figure 6A:
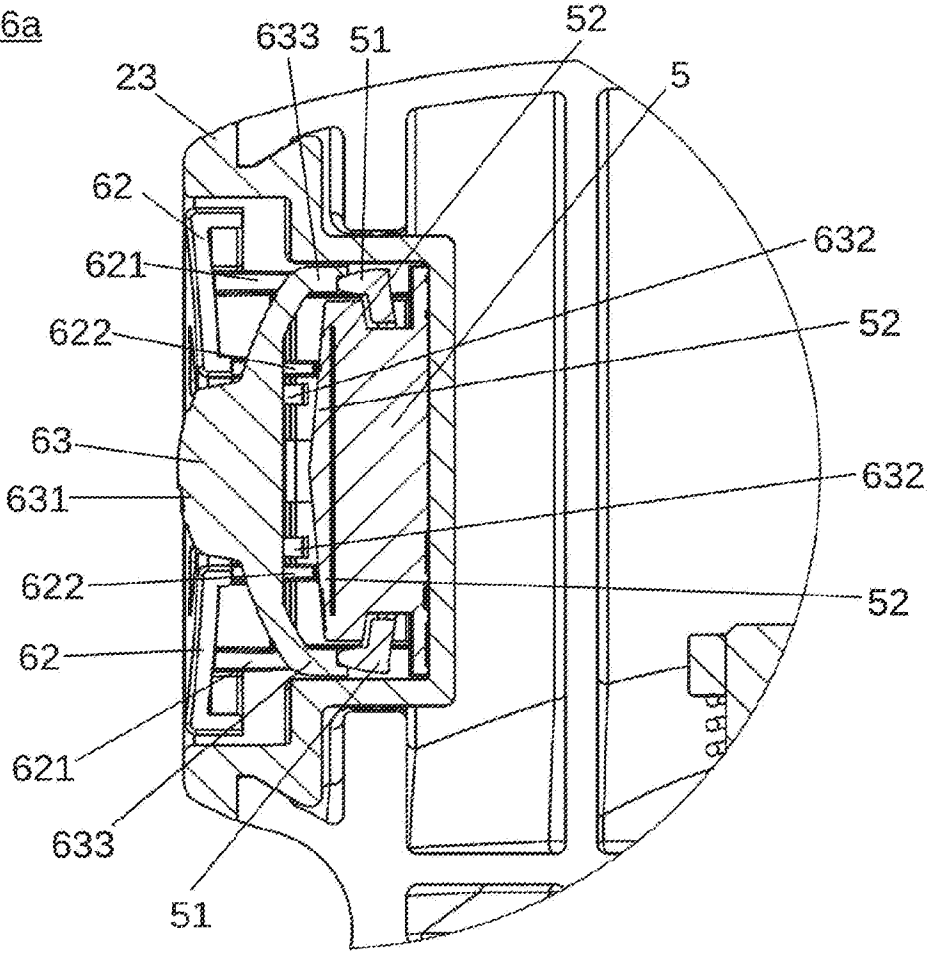
FIG. 6*a* is a detail VIa from FIG. 6.
Figure 8:
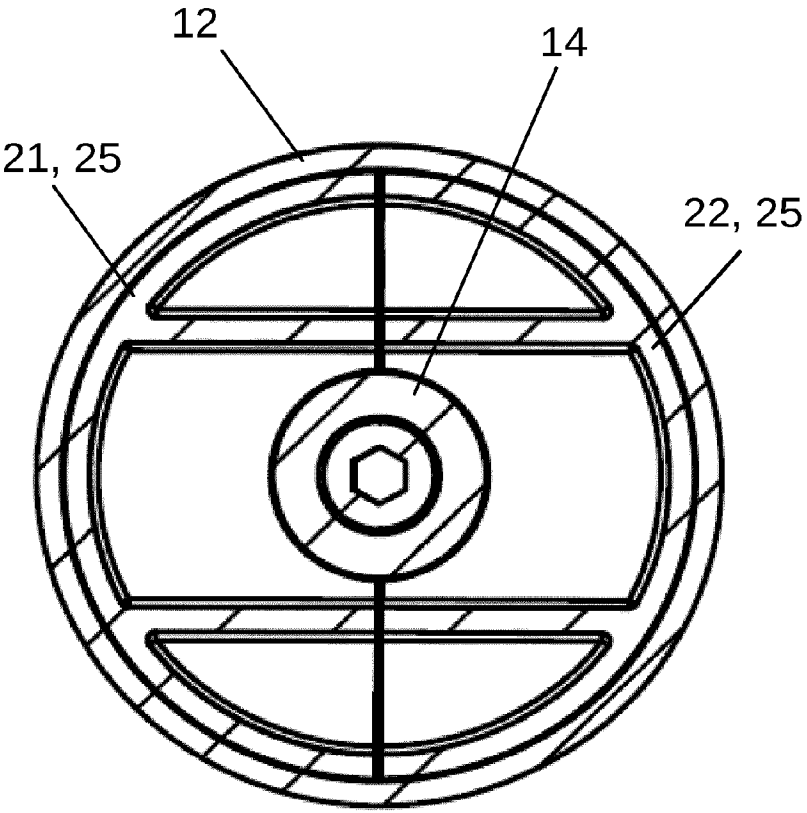
FIG. 8 is a section through the handle-sensor unit along the line VIII-VIII in FIG. 1.
Figure 7:
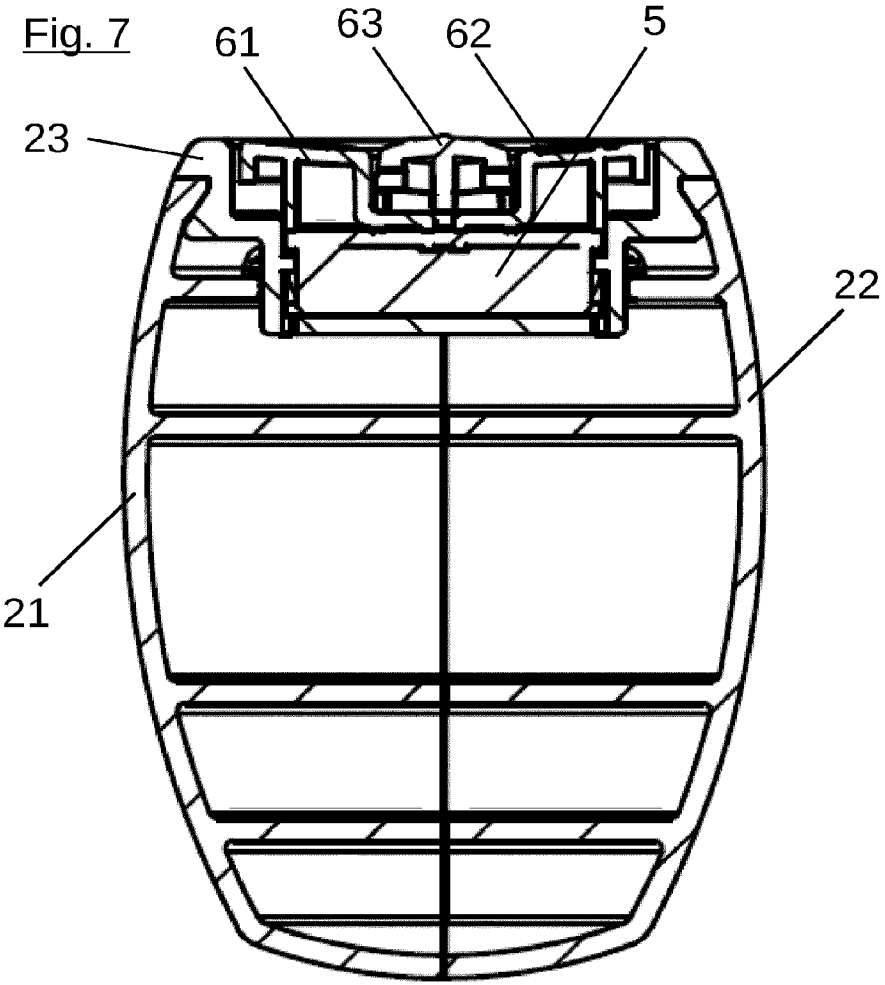
FIG. 7 is a section through the handle-sensor unit along the line VII-VII in FIG. 1.

As shown in FIG. 9, the bed 100 comprises a head part 102, a foot part 104, at least one side part 106, and a height-adjustable lying surface 108 upon which a mattress 110 may rest. In FIG. 9, a part of the lying surface 108 is shown to be in an inclined position. The head part, the foot part, and/or the at least one side part of the bed may comprise support structure or support structures for supporting the handle-sensor unit, as previously described herein. The handle-sensor unit (generally denoted by reference character 120 in FIG. 9) may be releasably mounted to either support structure 113 of the head part, support structure 114 of the foot part or support structure 116 of the at least one side part by a fastening element (shown in more detail in FIGS. 1-2). In the embodiment of the bed shown in FIG. 9, the handle-sensor unit is mounted to support structure 116 (which, for example, may be a handrail) of the at least one side rail 106, as previously described herein. In alternative embodiments of the bed, however, the handle-sensor unit may be releasably mounted to support structure 113 of the head part or support structure 114 of the foot part, as shown by the phantom line form depiction of the handle-sensor unit.

Referring again to FIG. 9, the bed further includes a motor 117 to adjust the height of the lying surface, as shown by directional arrow 122, and another motor 118 to adjust the inclination of a part of the lying surface, as shown by directional arrow 124. In the embodiment of the bed illustrated in FIG. 9, a part of the lying surface of the bed is shown in an inclined state with head part 102 and foot part 104 projecting beyond the mattress 110 of the bed.

What is claimed is:

1. A bed, comprising:

a height-adjustable lying surface, upon which a mattress rests;

a head part, a foot part, and/or at least one side part, wherein at least one of the parts in at least one state of the bed projects beyond the mattress of the bed;

a motor for adjusting the height of the lying surface as a mechanism for assisting standing up; and a control system for controlling the motor to adjust the height, wherein the control system comprises:

at least one sensor including at least one actuating element actuatable to generate a control signal, an interface to emit the control signal, and at least one element for producing energy independent of wired and battery-supported energy supply sources, wherein the energy necessary for generating and transmitting the control signal is generated from the actuation of the at least one actuating element of the sensor from the outside; and at least one actuator including an interface to receive the control signal, and a switching element to switch at least one current path or an adjusting element to set at least one voltage, one current or another physical variable on the basis of the control signal.

2. The bed of claim 1, wherein the sensor further comprises at least one fastening element by which the sensor is attachable to the head part, the foot part, and/or the side part.

3. The bed of claim 2, wherein the head part, the foot part, and/or the side part comprise support structure on which the sensor is mountable without a tool by interaction with the at least one fastening element.

4. The bed of claim 1, wherein the interface of the sensor and the interface of the actuator are radio interfaces.

5. The bed of claim 1, wherein the at least one element for producing energy is a piezo element or an electrodynamic energy converter.

6. The bed of claim 5, wherein the at least one actuating element is configured for mechanical actuation and is operatively connected to the piezo element or to the electrodynamic energy converter.

7. The bed of claim 1, wherein the at least one actuating element comprises a rocker or a key or is actuatable by a rocker or a key.

8. The bed of claim 1, wherein the bed comprises at least one further motor to adjust the inclination of the lying surface or a part of the lying surface.

9. The bed of claim 1, wherein a handle-sensor unit, which includes the sensor, comprises a receptacle on the sensor as fastening elements with undercut edges.

10. The bed of claim 9, wherein the receptacle is plugged, clipped, or pushed onto support structure of the bed, and the support structure is designed to be complementary to the receptacle.

11. The bed of claim 1, wherein the bed comprises a handle as a mechanism for assisting standing up, and the handle and the sensor are parts of a handle-sensor unit of the bed.

12. The bed of claim 11, wherein the handle comprises a foot, which comprises one or more fastening elements, and a head rotatably connected to the foot.

13. The bed of claim 12, wherein the at least one actuating element is provided in or on the head.

14. The bed of claim 11, wherein the head substantially has a spherical shape or a barrel shape.

15. The bed of claim 1, wherein the bed is a hospital bed or a nursing care bed.

16. A bed, comprising:

a height-adjustable lying surface, upon which a mattress rests;

a head part, a foot part, and/or at least one side part, wherein at least one of the parts in at least one state of the bed projects beyond the mattress of the bed;

a motor for adjusting the height of the lying surface as a mechanism for assisting standing up; and a control system for controlling the motor to adjust the height, wherein the control system comprises:

at least one sensor including: at least one actuating element that can be actuated to generate a control signal, an interface to emit the control signal, and at least one element for producing energy, by which energy needed for generating and transmitting the control signal can be generated via actuation of the sensor from the outside;

at least one actuator including: an interface to receive the control signal, and a switching element to switch at least one current path or an adjusting element to set at least one voltage, one current or another physical variable on the basis of the control signal; and a receiver side part, which includes the actuator or actuators, that is capable of being activated by the simultaneous actuation of all or some actuating elements of the sensor.

* * * * *